US006966468B2

(12) United States Patent
McKay et al.

(10) Patent No.: US 6,966,468 B2
(45) Date of Patent: Nov. 22, 2005

(54) DISPENSER WITH ADJUSTABLE LATERAL POWDER FLOW

(75) Inventors: Annalisa McKay, Carlingford (AU); Joice Wang, Sylvania (AU); Jun Lu, Shanghai (CN); Christine Andrea Ruhotas, Bexley (AU); Xiaohai Lu, Shanghai (CN); Min Xu, Shanghai (CN); Anthony Gallo, Warren, NJ (US)

(73) Assignee: Johnson & Johnson (China) Ltd., (CN)

( * ) Notice: Subject to any disclaimer, the term of this patent is extended or adjusted under 35 U.S.C. 154(b) by 219 days.

(21) Appl. No.: 10/462,246

(22) Filed: Jun. 16, 2003

(65) Prior Publication Data

US 2004/0217138 A1 Nov. 4, 2004

(30) Foreign Application Priority Data

Apr. 30, 2003 (CN) ..... 3136054

(51) Int. Cl.[7] ..... B67D 3/00

(52) U.S. Cl. ..... 222/486; 222/548; 222/553; 222/519; 222/48; 220/253

(58) Field of Search ..... 222/484, 485, 222/486, 548, 553, 519, 48; 220/253

(56) References Cited

U.S. PATENT DOCUMENTS

| | | | | | |
|---|---|---|---|---|---|
| 1,714,368 | A | * | 5/1929 | Hobson | 222/553 |
| 2,321,031 | A | * | 6/1943 | Lateur | 222/80 |
| 2,328,246 | A | * | 8/1943 | Albion | 222/553 |
| 3,207,390 | A | * | 9/1965 | Short | 222/553 |
| 3,295,730 | A | * | 1/1967 | Moran | 222/553 |
| 3,403,828 | A | * | 10/1968 | Frank | 222/486 |
| 3,447,725 | A | * | 6/1969 | Armour | 222/486 |
| 4,376,497 | A | * | 3/1983 | Mumford | 222/153.14 |
| 4,544,063 | A | * | 10/1985 | Neward | 206/540 |
| 4,961,515 | A | * | 10/1990 | Schreiber | 222/48 |
| 5,303,850 | A | * | 4/1994 | Connan | 222/153.07 |

* cited by examiner

*Primary Examiner*—Michael Mar
*Assistant Examiner*—Melvin A. Cartagena

(57) ABSTRACT

The present invention relates to an adjustable flow rate dispenser comprising a dispenser body having a closed end, a flanged open end, at least one relatively large laterally disposed powder dispensing opening, at least one relatively small laterally disposed powder dispensing opening, and a retaining ring; and a cap having an open end, a closed end, a laterally disposed powder dispensing opening, and a snap bead, wherein when the cap is placed on the body, the snap bead engages the retaining ring providing a twistingly engaged cap and body.

6 Claims, 6 Drawing Sheets

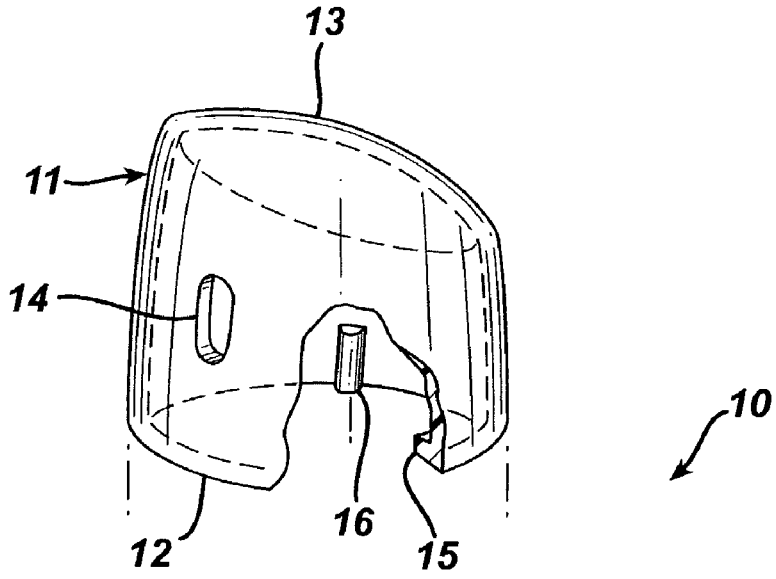
FIG. 2
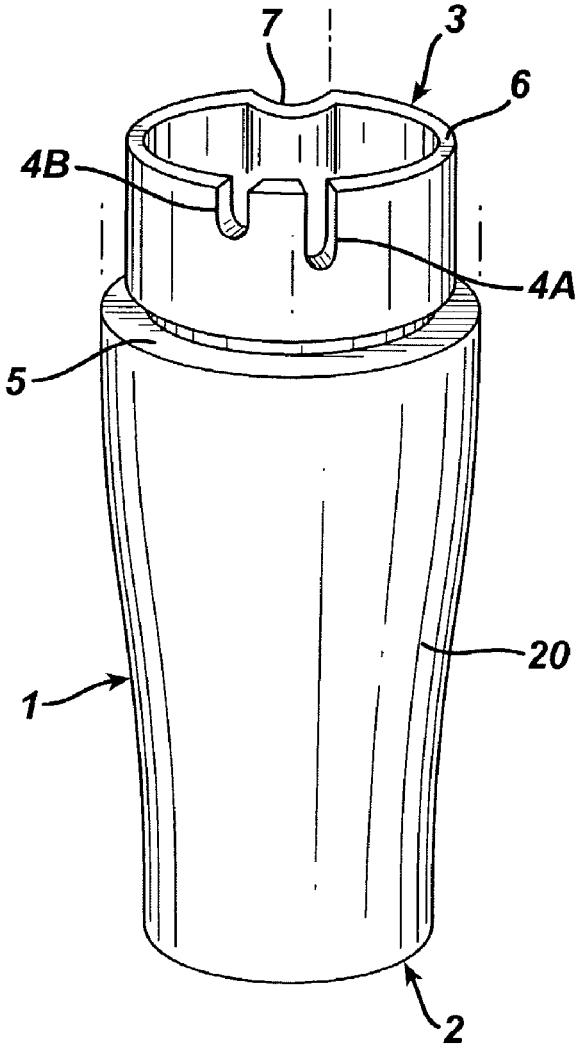

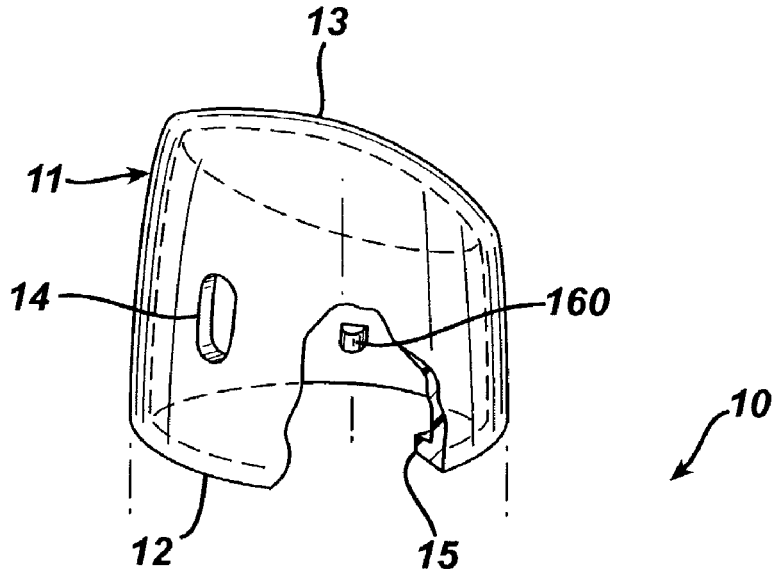
FIG. 5
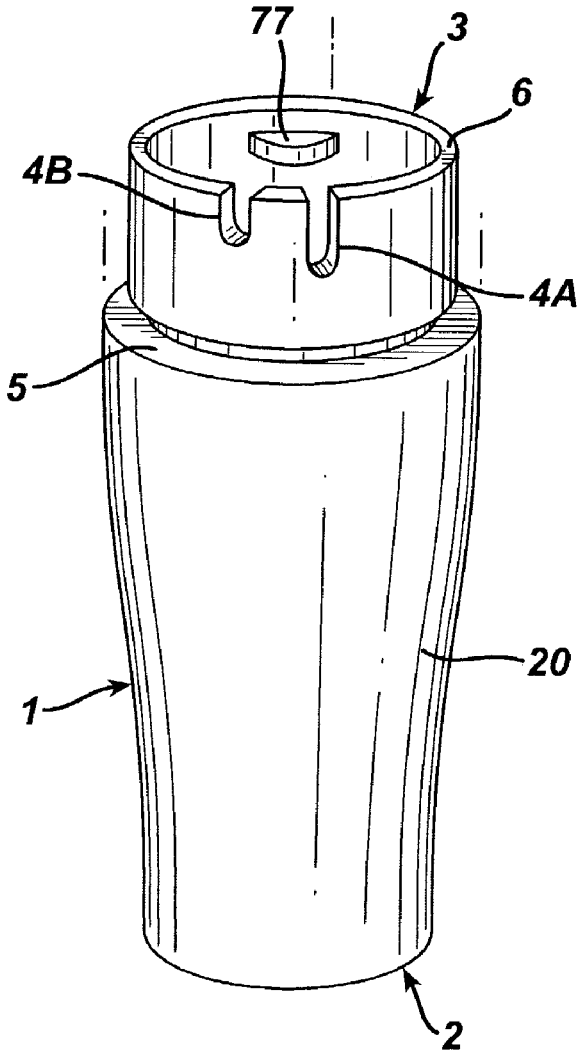

DISPENSER WITH ADJUSTABLE LATERAL POWDER FLOW

This application claims the priority benefit of Chinese Patent Application Number 03136054.8 filed Apr. 30, 2003, which is hereby incorporated by reference herein.

BACKGROUND OF THE INVENTION

1. Field of the Invention

The present invention relates to an improvement in a container for dispensing particulate matter such as powders or finely ground fibers as, for example, talc, body portion powders, baby powders, cosmetic face powders, soap powders, infant formulas, and the like. In particular, this invention is directed toward the design and method of assembling of a container that is not only more economically beneficial to manufacture, but also provides selectively adjustable flow rates of the matter contained therein.

2. Description of the Prior Art

Commercially available dispensers for particulate matter typically comprise a body portion for containing the powder and a cap for dispensing the powder. Some of these dispensers also provide the user with the ability to adjust the flow rate of the matter contained therein by providing two or more openings of different sizes in the cap.

One example of an adjustable dispenser for particulate matter is that used for dispensing grated cheese. Typically, such dispensers comprise a cylindrically shaped bottle for retaining the cheese, and a two-piece dispensing cap covering the open end of the bottle. The first cap piece contains a relatively large cheese-dispensing opening. The second cap piece, which lies upon the first cap piece and is twistingly engaged with the first cap piece, contains several relatively smaller openings for shaking out a small amount of cheese, and distal therefrom a relatively larger opening for pouring relatively larger amounts. When the opening on the first cap piece is aligned with one or more openings in the second cap piece and the bottle is inverted, the cheese can be dispensed. When the openings are not aligned, the cheese is retained in the bottle.

Disadvantageously, such commercially available adjustable flow powder dispensers are relatively expensive to manufacture due to the need to produce at least three separate pieces. In addition, the dispenser must be inverted in order to dispense the powder, which thereby causes all of the powder to rest on and dog the dispensing openings. It is thereby difficult and inconvenient to dispense the powder from such dispensers without vigorous shaking.

There is a need for an adjustable flow rate powder dispenser that is relatively inexpensive to produce and convenient to use.

SUMMARY OF THE INVENTION

The present invention provides a dispenser container for containing and selectively dispensing a flowable material comprising, consisting of, and/or consisting essentially of:

a) a body portion having an open upper end, a dosed lower end opposite thereto, and sidewalls therebetween, the sidewalls further having a first lateral opening extending downward from the upper end and a second lateral opening extending downward from the upper end, wherein the first lateral opening is distal from the second lateral opening and the size of the first lateral opening is smaller than the size of the second lateral opening, b) a cap overlying the upper end and engaged upon the body portion, the cap having an open end, a closed end opposite thereto, and cap sidewalls therebetween, the cap sidewalls further having a laterally disposed cap opening, wherein when the cap is twistingly rotated relative to the dispenser container such that neither the first lateral opening nor the second lateral opening are in alignment with the laterally disposed cap opening, the material is retained within the body portion, and when the cap is twistingly rotated such that the first lateral opening in the body portion is in alignment with the laterally disposed cap opening, the material may be dispensed from the bottle at a first flow rate, and when the cap is twistingly rotated such that the second lateral opening in the body portion is in alignment with the laterally disposed cap opening, the material may be dispensed from the bottle at a second flow rate that is faster than the first flow rate.

Yet another embodiment of the present invention is directed to a method for assembling a dispenser container for containing and selectively dispensing a flowable material wherein the dispenser container is comprised of:

a) a body portion having an open upper end, a closed lower end opposite thereto, and sidewalls therebetween, the sidewalls further having a first lateral opening extending downward from the upper end and a second lateral opening extending downward from the upper end, wherein the first lateral opening is distal from the second lateral opening and the size of the first lateral opening is smaller than the size of the second lateral opening, and b) a cap overlying the upper end and engaged upon the body portion, the cap having an open end, a dosed end opposite thereto, and cap sidewalls therebetween, the cap sidewalls further having a laterally disposed cap opening, the method comprising, consisting of, and/or consisting essentially of:

a) filling the body portion with a desired amount of flowable material through the upper end; and b) securing the cap to the upper end of the body portion.

Yet another embodiment of the present invention is directed to a method for assembling a dispenser container for containing and selectively dispensing a flowable material wherein the dispenser container is comprised of:

a) a body portion having an open upper end, an open lower end opposite thereto, and sidewalls therebetween, the sidewalls further having a first lateral opening extending downward from the upper end and a second lateral opening extending downward from the upper end, wherein the first lateral opening is distal from the second lateral opening and the size of the first lateral opening is smaller than the size of the second lateral opening, and b) a cap overlying the upper end and engaged upon the body portion, the cap having an open end, a closed end opposite thereto, and cap sidewalls therebetween, the cap sidewalls further having a laterally disposed cap opening, the method comprising:

a) securing the cap to the upper end of the body portion;

b) filling the body portion with a desired amount of flowable material through the open lower end; and b) securing a base plate to the lower end of the body portion.

BRIEF DESCRIPTION OF THE DRAWINGS

The invention will be more fully understood and further advantages will become apparent when reference is made to the following detailed description of the invention and the accompanying drawings in which:

FIG. 2 is an exploded perspective view of the dispenser container with cap of FIG. 1, which is partially broken away to illustrate the interconnection between the various elements.

FIG. 5 is an exploded perspective view of an alternative embodiment of the dispenser container with cap of FIG. 1, which is partially broken away to illustrate the interconnection between the various elements.

DETAILED DESCRIPTION OF PREFERRED EMBODIMENTS

Figure 1:
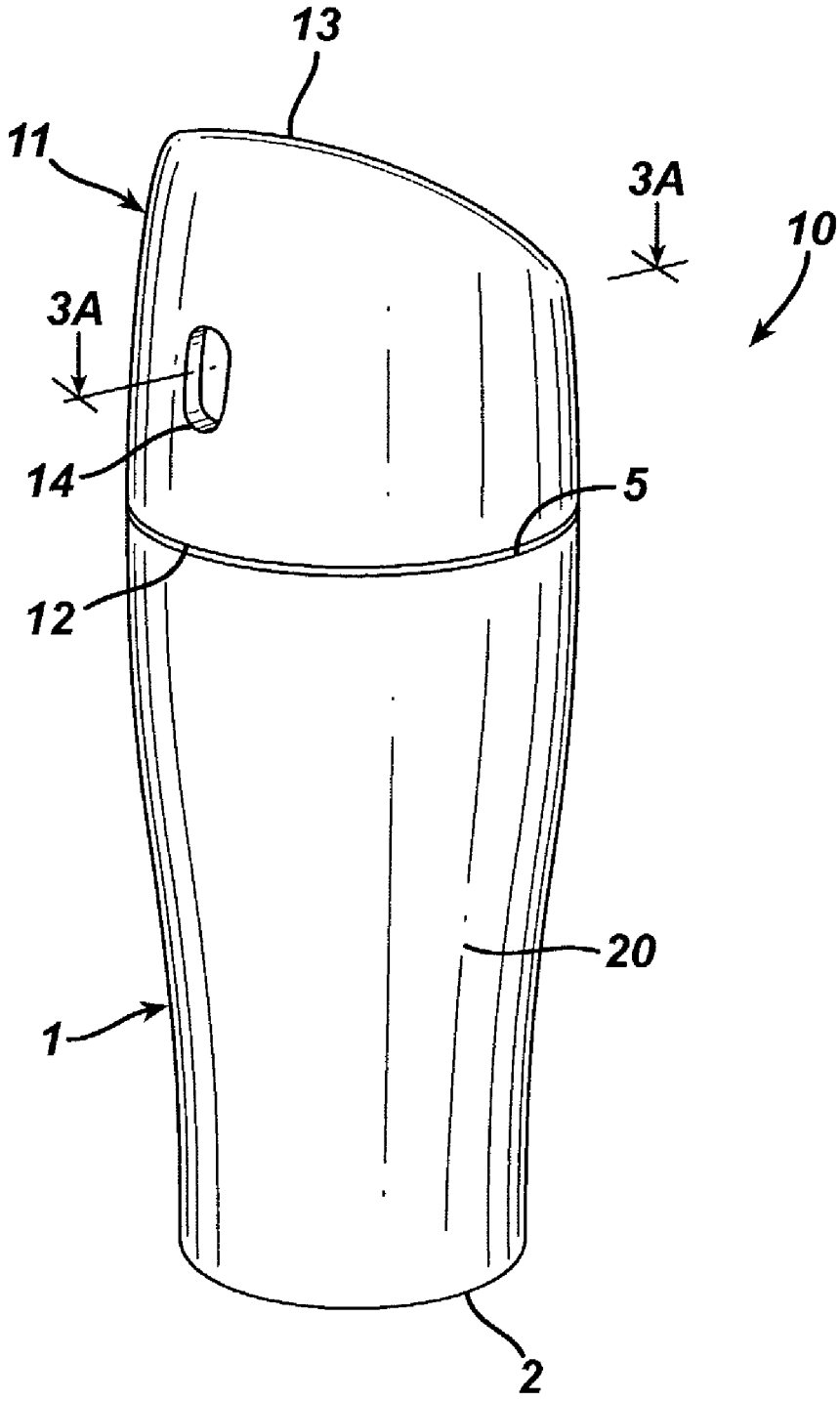
FIG. 1 is a perspective view of one embodiment of the dispenser container with cap of the present invention.

As shown in FIGS. 1 and 2, the dispenser container 10 of the present invention has a body portion 1 having a closed lower end 2, an open upper end 3, and sidewalls 20 therebetween. Along the circumference of the sidewalls 20 near the upper end 3 of the body portion 1 is a retaining ring 5. Although the shape of the body portion 1 is not critical, the body portion 1 shown in FIG. 1 has a generally inverted cup shape.

The body portion 1 may be made by any process known in the art, such as blow molding, as well as by more economical methods such as injection molding, thermoforming, and vacuum forming. The body portion 1 may be comprised of any suitable material known in the art. Suitable materials include, but are not limited to, polyethylene, polypropylene, polyvinyl chloride, polyethylene terephthalate, polystyrene, and polymers and blends thereof.

Laterally disposed from the flange 6 of the body portion 1 is a first lateral opening 4A in the sidewall 20, and proximate thereto is a relatively smaller, second lateral opening 4B in the sidewall 20. These openings, 4A, 4B may be of any shape known in the art. Suitable shapes include circles, stars, ovals, ellipses, hearts, diamonds, and slots.

As shown in FIGS. 2 and 3, after the body portion 1 is filled with the desired amount of particulate matter, a cap 11 having an open end 12, a closed end 13, a laterally disposed cap opening 14 in the sidewalls 25, and a snap bead 15 extending around its circumference may be secured on to the upper end 3 of the body portion 1 such that the snap bead 15 on the cap 11 is in a twistingly engaged position with the retaining ring 5. Although not shown, the cap 11 may be secured to the body portion 1 via any means known in the art that would enable the cap 11 and body portion 1 to move in a twisting engagement.

The cap 11 may be made by any process known in the art, such as blow molding, as well as by more economical methods such as injection molding, thermoforming, and vacuum forming. The cap 11 may be comprised of any suitable material known in the art. Suitable materials include, but are not limited to, polyethylene, polypropylene, polyvinyl chloride, polyethylene terephthalate, polystyrene, and polymers and blends thereof. The shape of the cap 11 is not critical, although its shape may be chosen on the basis of aesthetics and/or to functionally complement the configuration of the upper end 3 of the body portion 1.

Figure 3A:
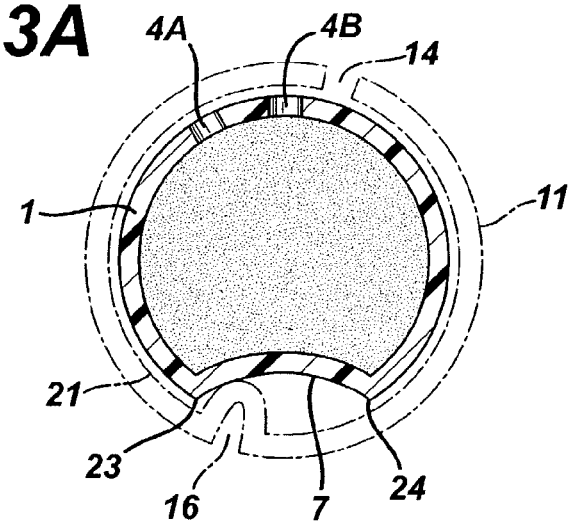
FIG. 3A is a top view of the dispenser container with cap of FIG. 1 wherein the cap and dispenser are aligned such that the contents are retained in the bottle.
Figure 3B:
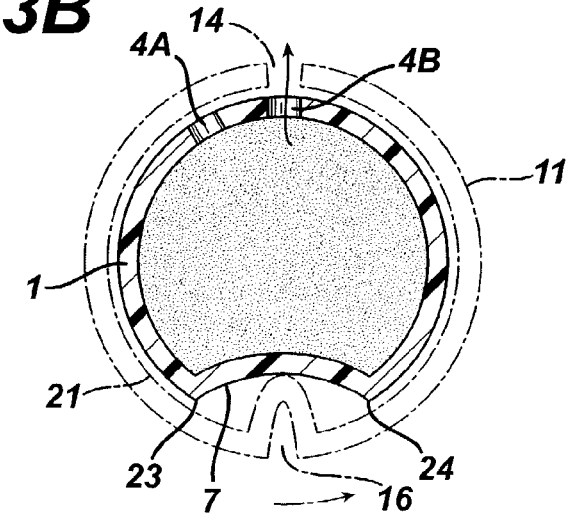
FIG. 3B is a top view of the dispenser container with cap of FIG. 1 wherein the cap and dispenser are aligned such that the contents may be dispensed at a relatively low flow rate.
Figure 3C:
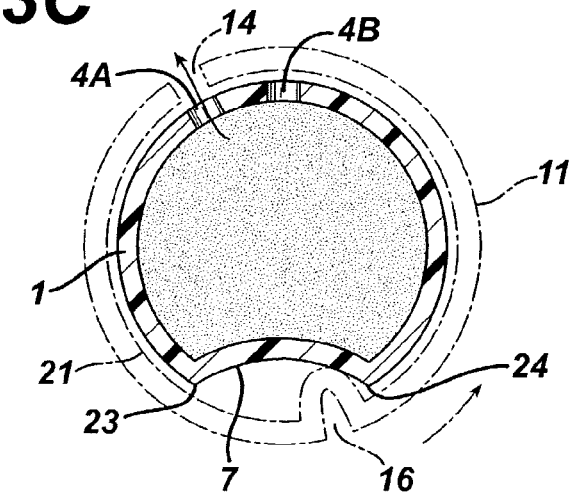
FIG. 3C is a top view of the dispenser container with cap of FIG. 1 wherein the cap and dispenser are aligned such that the contents may be dispensed at a relatively high flow rate.
Figure 6A:
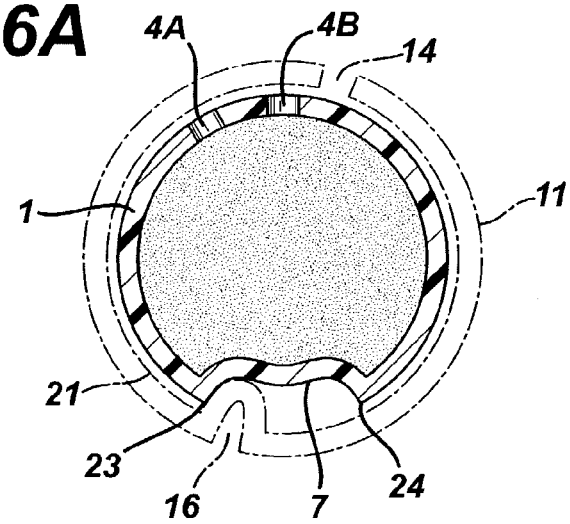
FIG. 6A is a top view of an alternative embodiment of the dispenser container with cap of FIG. 1 wherein the cap and dispenser are aligned such that the contents are retained in the bottle.
Figure 6B:
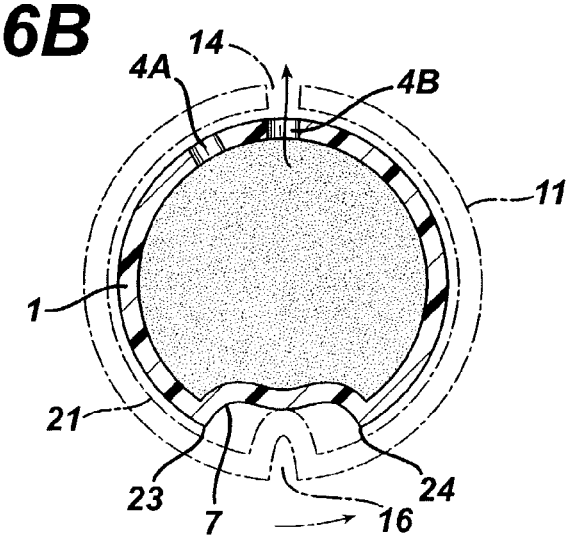
FIG. 6B is a top view of an alternative embodiment of the dispenser container with cap of FIG. 1 wherein the cap and dispenser are aligned such that the contents may be dispensed at a relatively low flow rate.
Figure 6C:
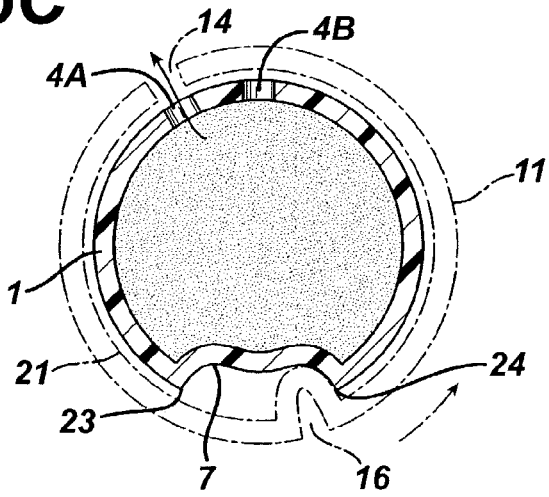
FIG. 6C is a top view of an alternative embodiment of the dispenser container with cap of FIG. 1 wherein the cap and dispenser are aligned such that the contents may be dispensed at a relatively high flow rate.

The twisting relationship between the cap 11 and the body portion 1 is illustrated in FIGS. 3A, 3B, 3C, 4, 5, 6A, 6B, and 6C. In one embodiment shown in, for example, FIG. 2 and FIG. 3A, a protrusion 16 extends inwardly from the inner wall 21 of the cap 11 and is received by an indentation 7 in the sidewall 20 of the body portion 10. In this position, the protrusion 16 abuts against a first end 23 of the indentation 7, and the contents are retained in the body portion 1 because neither openings 4A, 4B are in alignment with the cap opening 14. The shape of the indentation 7 may be arcuate, as illustrated in FIGS. 3A–3C, or may be multi-arcuate, as illustrated in FIGS. 6A to 6C.

The shape of the indentation 7 and protrusion 16 are not critical. Alternatively (not shown), a protrusion 16 may extend from the sidewall 20 of the body portion 10 into an indentation in the cap 11. In yet another alternative embodiment shown in FIG. 5, a protrusion 160 may extend into a notch 77 formed in the sidewall of the body portion 1.

In another embodiment shown in FIG. 3B, the cap 11 has been rotated in a counterclockwise manner relative to the body portion 1 such that only the relatively smaller opening 4B in the sidewall 20 of the body portion 1 is in alignment with the cap opening 14 in the cap 11. In this position, the protrusion 16 is received within the indentation 7 of the body portion 1, but does not abut against the first end 23 or the second end 24; thus, the contents within the body portion 1 may be dispensed therefrom at a relatively slow flow rate.

In yet another embodiment shown in FIG. 3C, the cap 11 has been further rotated in a counterclockwise manner relative to the body portion 1 such that only the relatively larger opening 4A in the sidewall 20 of the body portion 1 is in alignment with the cap opening 14 in the cap 11. In this position, the protrusion 16 abuts against the second end 24 of the indentation 7; thus, the contents within the body portion 1 may be dispensed therefrom at a faster flow rate relative to that permitted by the position illustrated in FIG. 3B.

Figure 4:
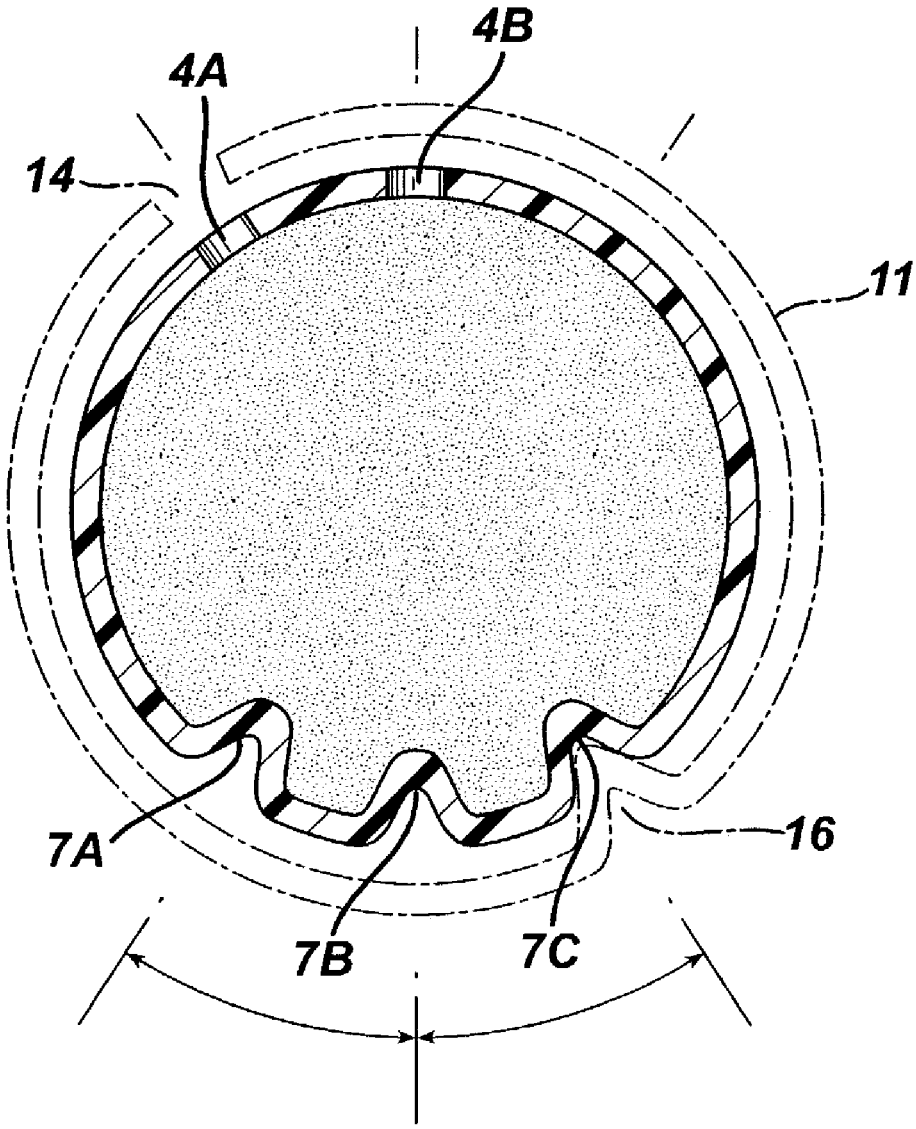
FIG. 4 is a cross sectional view of another embodiment of the dispenser container with cap of the present invention wherein the dispenser container has multiple stop positions.

In yet another embodiment shown in FIG. 4, multiple stops or stop lugs may be provided by a plurality of indentations 7A, 7B, and 7C in the body portion 1. Similar to the embodiments of FIG. 3A through FIG. 3C, the cap 11 may be rotated relative to the body portion 1. When the cap 11 is rotated such that protrusion 16 is received within the indentation 7C, only the opening 4A is aligned with the cap opening 14. In this position, the contents contained within the body portion 1 may be dispensed therefrom at a relatively fast flow rate. When the cap is further rotated in a clockwise manner such that the protrusion 16 is received within the indentation 7B of the body portion 1 (not shown), only the opening 4B is aligned with the cap opening 14. In this position, the contents contained within the body portion 1 may be dispensed therefrom at a relatively slow flow rate. When the cap is further rotated in a clockwise manner such that the protrusion 16 is received within the indentation 7A of the body portion 1 (not shown), none of the openings 4A, 4B are aligned with the cap opening 14. In this position, the dispenser is closed, and the contents are retained within the body portion 1. It is understood that the location of opening 4A may be interchanged with the that of opening 4B such that the cap may be rotated in a counterclockwise manner to achieve the above benefits.

Alternatively, the cap 11 may be secured to a body portion 1 having an open lower end 2 (not shown). After the cap 11 is moved to a closed position, the body portion 1 may be inverted to permit it to be filled with the desired amount of particulate material through its open lower end 2. A base plate may then be secured to the open lower end 2 of the body portion 1 via any securing means known in the art. Suitable securing means include, but are not limited to, adhesives, ultrasonic welding, thermal bonding, and the like. The thickness of the base plate may vary depending upon various factors such as, for example, the type of particulate material in the body portion 1, and the desired durability of the resulting dispenser. However in general, the thickness of the base plate 7 may range from about 0.04 mil to about 0.85 mil.

Because the contents of the body portion 1 may be dispensed by aligning either of the laterally disposed openings 4A, 4B in the body portion 1 with the cap opening 14, the user only needs to slightly tilt and mildly shake the dispenser container in order to dispense the contents. Unlike prior art variable-flow dispensers, all of the contents do not rest upon the openings during use, which thereby reduces the risk of dogs. Furthermore, because the dispenser with cap of the present invention has only two separate parts, it is relatively less expensive to produce relative to the three-piece, variable dispensers of the prior art.

An example is set forth below to further illustrate the nature of the invention and the manner of carrying it out. However, the invention should not be considered as being limited to the details thereof.

EXAMPLE 1

A polyvinyl chloride cup-shaped body having a dosed end, a flanged open end, a small powder dispensing opening in the shape of a vertical slot in its sidewall, a large powder dispensing opening in the shape of a vertical slot in its sidewall, an indentation for receiving a stop lug, and a retaining ring was vacuum formed in the shape shown in FIG. 1. A polyvinyl chloride snap-on cap having an open end, a closed end, a stop lug protrusion, a snap bead, and a powder dispensing opening in the shape of a vertical ellipse was formed by an injection molding process.

After the container was filled with commercially available baby powder, the cap was snapped onto the open end of the body.

The container provided an easy to use, adjustable flow rate powder dispenser.

We claim:

1. A dispenser container for containing and selectively dispensing a flowable material comprising:

a) a body portion having an open upper end, a closed lower end opposite thereto, and sidewalls therebetween, the sidewalls further having a first lateral opening extending downward from the upper end and a second lateral opening extending downward from the upper end, wherein the first lateral opening is distal from the second lateral opening and the size of the first lateral opening is smaller than the size of the second lateral opening, b) a cap overlying the upper end and engaged upon the body portion, the cap having an open end, a closed end opposite thereto, and cap sidewalls therebetween, the cap sidewalls further having a laterally disposed cap opening, wherein when the cap is twistingly rotated relative to the dispenser container such that neither the first lateral opening nor the second lateral opening are in alignment with the laterally disposed cap opening, the material is retained within the bottle, and when the cap is twistingly rotated such that the first lateral opening in the body portion is in alignment with the laterally disposed cap opening, the material may be dispensed from the bottle at a first flow rate, and when the cap is twistingly rotated such that the second lateral opening in the body portion is in alignment with the laterally disposed cap opening, the material may be dispensed from the bottle at a second flow rate that is faster than the first flow rate.

2. The dispenser container according to claim 1, wherein the cap sidewalls further comprise an inwardly extending protrusion offset from the laterally disposed cap opening.

3. The dispenser container according to claim 2 wherein the open upper end of the body portion is comprised of an indentation such that when the cap is rotated, the protrusion is received by the indentation.

4. The dispenser container according to claim 3 wherein the open upper end of the bottle is comprised of a plurality of indentations.

5. The dispenser container according to claim 1 wherein at least the laterally disposed cap opening, the first lateral opening, or the second lateral opening is in a shape selected from the group consisting of circles, stars, ovals, ellipses, hearts, diamonds, and slots.

6. The dispenser container according to claim 1 wherein at least the laterally disposed cap opening, the first lateral opening, or the second lateral opening is in the shape of a vertical slot.

* * * * *